United States Patent [19]

Massa et al.

[11] Patent Number: 4,700,333

[45] Date of Patent: Oct. 13, 1987

[54] HYDROPHONE DESIGN TO OVERCOME REDUCTION IN LEAKAGE RESISTANCE BETWEEN ELECTRODE SURFACE OF TRANSDUCER ELEMENT ASSEMBLY AND THE WATER IN WHICH THE HYDROPHONE IS IMMERSED

[75] Inventors: Frank Massa; Donald P. Massa, both of Cohasset, Mass.

[73] Assignee: The Stoneleigh Trust, Cohasset, Mass. ; Fred M. Dellorfano, Jr. and Donald P. Massa, trustees

[21] Appl. No.: 734,549

[22] Filed: May 16, 1985

[51] Int. Cl.[4] ..... H04R 17/00

[52] U.S. Cl. ..... 367/157; 367/188; 174/52 PE

[58] Field of Search ..... 367/188, 157, 163, 174; 174/52 PE

[56] References Cited

U.S. PATENT DOCUMENTS

| | | | |
|---|---|---|---|
| 3,167,668 | 1/1965 | Nesh | 367/157 |
| 4,030,175 | 6/1977 | McShane | 174/52 PE |
| 4,039,904 | 8/1977 | Klein et al. | 174/52 PE |
| 4,110,727 | 8/1978 | Kriege | 367/157 |
| 4,117,449 | 9/1978 | McNeel | 367/188 |

*Primary Examiner*—Deborah L. Kyle
*Assistant Examiner*—Ted L. Parr

[57] ABSTRACT

The insulation resistance between the electroded surfaces of an underwater transducer and the water within which the transducer is immersed is greatly improved by coating the electroded surface of the transducer with a layer of air-free, high-resistance waterproof material before bonding an elastomer covering over the assembly to serve as the outer housing.

10 Claims, 3 Drawing Figures

HYDROPHONE DESIGN TO OVERCOME REDUCTION IN LEAKAGE RESISTANCE BETWEEN ELECTRODE SURFACE OF TRANSDUCER ELEMENT ASSEMBLY AND THE WATER IN WHICH THE HYDROPHONE IS IMMERSED

This invention relates to hydrophones and more particularly to hydrophones which utilize an elastomeric rubberlike housing structure. It is well known to those skilled in the art that elastomers are permeable in varying degrees to the slow long time penetration of water molecules through the wall of the housing material when the hydrophone is put into service and is submerged for long periods of time. The slow water migration through the housing wall results in a reduction of the insulation resistance between the electrode surfaces of the hydrophone structure and the water in which the hydrophone is immersed. This situation may become objectionable especially for ceramic type hydrophones which operate in the lower audible frequency region where the electrical impedance of the hydrophone ceramic element assembly is relatively high. Exercising proper production controls during the manufacture of underwater transducers, it is possible to achieve leakage resistance values in excess of 1,000 megohms between the electrode surface exposed to or making contact with the inner wall of the elastomer housing and the water into which the transducer is immersed. It is also a known fact that for many hydrophone structures, after several years of use in the fleet, the leakage resistance between the electrode surface and the water decreases significantly and in many instances, the hydrophones must be replaced at considerable expense.

One of the applicants has had over forty-five years experience in the design and manufacture of sonar transducers and during these years had improved the designs of many critical low frequency hydrophones so that the water permeability problem is improved and the useful life of the hydrophone is extended from a few years to the order of a decade. One satisfactory design employed a Butyl rubber housing enclosing a castor oil-filled hydrophone assembly. The Butyl housing assembly was then enclosed in a second Neoprene outer housing and the space between the two rubber housings was vacuum filled with a sound conducting liquid such as castor oil. This dual housing design, although effective in extending the service life of the hydrophone by maintaining a high leakage resistance between the electrode surfaces of the hydrophone and the water in which the hydrophone is immersed for many years, the size and cost of the dual housing assembly was significantly increased.

The primary object of this invention is to improve the design of a hydrophone structure contained within an elastomeric housing to extend its operating life by several years by inhibiting the long time effect of the permiation of water molecules through the housing wall of the hydrophone and thereby maintain very high leakage resistance for many years between the electroded surfaces of the hydrophone transducer element and the water within which the hydrophone is immersed.

Another object of this invention is to improve the insulation resistance of an underwater transducer between the electrode surface of the transducer element assembly, such as, for example, the outer electrode surface of a cylindrical piezoelectric ceramic transducer element assembly and the water in which the hydrophone is submerged, by applying a coating of air-free high-resistance waterproof material, such as epoxy or Butyl or their equivalents over the exposed electrode surfaces of the transducer element assembly before bonding an elastomer covering over the surface of the ceramic element assembly.

Still another object of this invention is to minimize the long time deterioration of the insulation resistance of an underwater transducer between the electroded surfaces of the transducer element assembly and the water within which the transducer is immersed during operation, especially for transducers employing an elastomer housing structure to separate the transducer element assembly from the water.

This invention contemplates other objects, features and advantages that will become more fully apparent from the following description taken in conjunction with the accompanying drawings in which.

Figure 1:
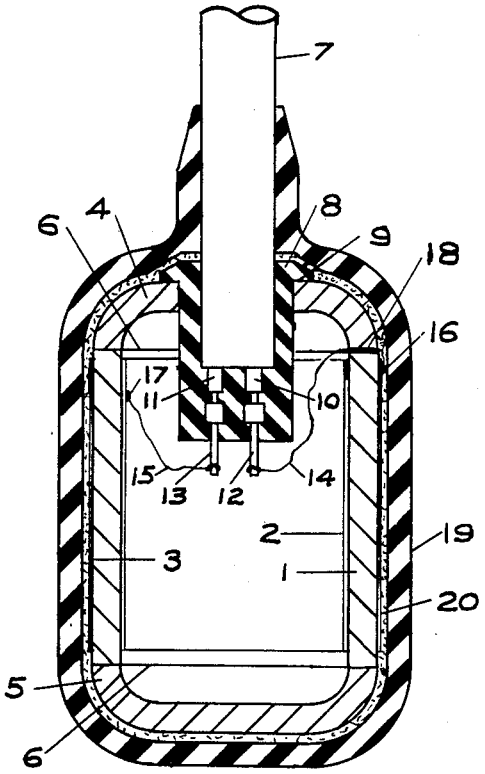
FIG. 1 is a cross-sectional view of a typical hydrophone construction which illustrates the application of this invention in greatly reducing the long time deterioration of the leakage resistance between the electrode surface of the transducer element assembly and the water into which the hydrophone is immersed during operation.

Referring more particularly to the drawings, FIG. 1 illustrates a typical underwater electroacoustic transducer construction that is well known to those skilled in the art. The reference character 1 illustrates a polarized piezoelectric ceramic cylinder 1 with electrode surfaces 2 and 3 bonded in the conventional manner as is well known in the art to the inner and outer surfaces respectively of the cylinder 1. Rigid end caps 4 and 5 are bonded to the ends of the ceramic cylinder 1 using a cement such as epoxy 6 as shown. An underwater cable 7 is sealed into an opening in the top end cap 4 by a shouldered epoxy plug 8 which is molded directly to the cable as illustrated and then sealed with epoxy cement 9 to the outer surface of the top cap 4 as shown. The two insulated conductors 10 and 11 are electrically connected to the shouldered terminal pins 12 and 13 before the solid epoxy plug 8 is molded to encapsulate the cable end as shown. Flexible leads 14 and 15 attached to the terminal pins 12 and 13 are connected to the electrode surfaces 3 and 2 by solder 16 and 17 as shown. The flexible lead 14 passes through a groove 18 in the bottom surface of the top cap 4 and then makes a soldered connection 16 to the outer electrode surface 3 of the ceramic 1 as illustrated. Finally, an outer housing covering of elastomer 19 is molded to the outer surface of the hydrophone element assembly to complete the electroacoustic transducer assembly. The illustrated construction is very well known in the art. It is also well known in the art that when the transducer assembly of FIG. 1 is immersed in the ocean and an alternating voltage is connected to the cable terminals, the diameter of the ceramic cylinder 1 will oscillate at the same frequency as the applied voltage and corresponding vibrations will be radiated as sound into the water. Alternately if sound vibrations are present in the water and impinge on the surface of the transducer assembly illustrated in FIG. 1, a corresponding alternating voltage signal will be generated at the electrode surfaces 2 and 3 of the ceramic 1 and will appear at the ends of the cable 7. This operational description of the transducer structure illustrated in FIG. 1 is also very well known to anyone skilled in the art of underwater transducer design.

The structure described in FIG. 1 has been used for many years in numerous sonar and other underwater applications. The design is very rugged and has been used extensively. When used as a receiving hydrophone for the reception of low audio frequency underwater sounds, the electrical impedance of the ceramic cylinder increases in direct proportion to the lowering of the operating frequency. To avoid reduction of the low frequency sensitivity of the ceramic hydrophone design, it is essential that the leakage electrical resistance between the conductor 10, which is connected to the outer electrode surface 3, and the water into which the hydrophone is immersed be kept very high which for very low frequencies means leakage resistance values generally in excess of 10 megohms. It has been found that for typical constructions using typical molded Neoprene housing structures the required high leakage resistance decreases gradually during several years of immersion on submarine and ship-mounted transducers. The basic object of this invention is to greatly inhibit the gradual deterioration of the leakage resistance between the outer electrode surface and the water by applying a waterproof high resistance coating 20 such as epoxy over the outer surface of the ceramic assembly before molding the outer jacket 19 over the ceramic assembly.

Figure 2:
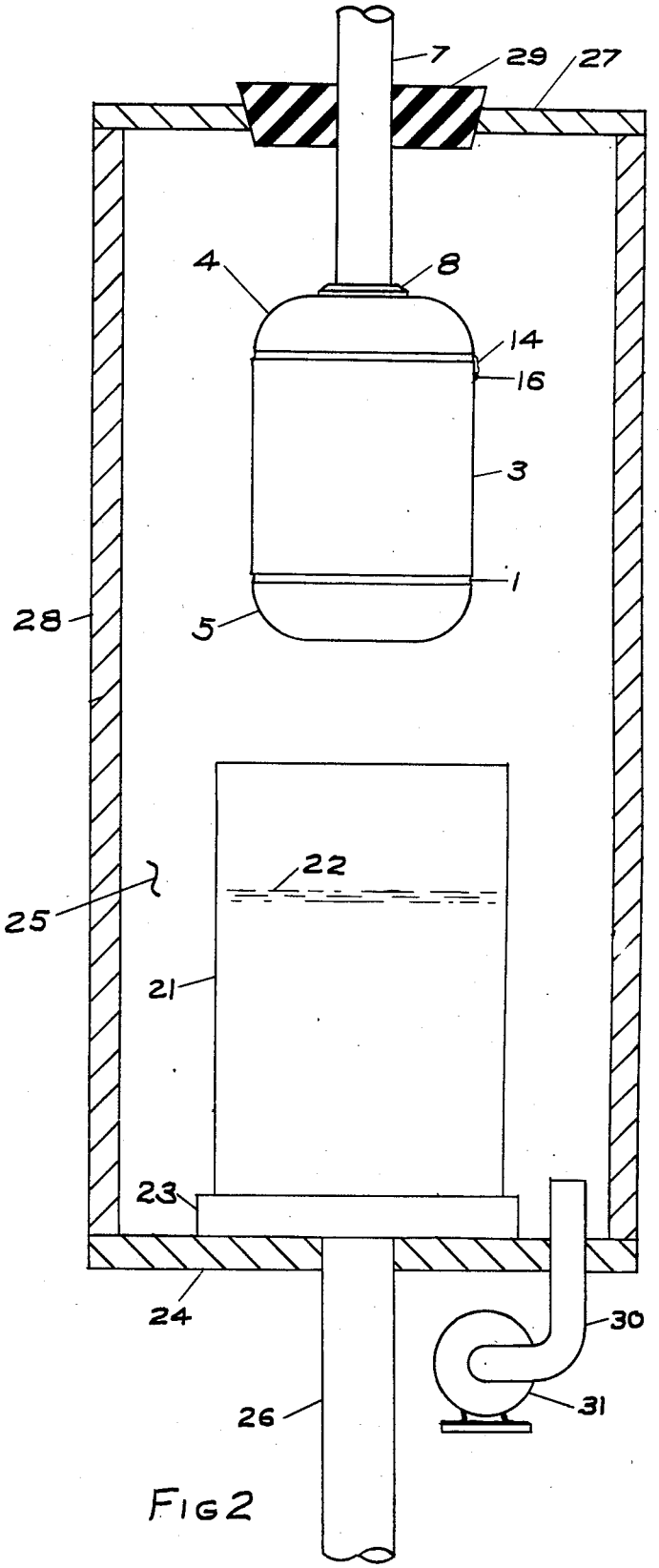
FIG. 2 is a schematic illustration of a vacuum coating procedure for applying a waterproof air-free high-resistance coating over the exposed electrode surface of the hydrophone element assembly before applying the elastomer housing covering over the outer surface of the transducer element assembly.

FIG. 2 schematically illustrates one successful procedure which Applicants have developed for applying the waterproof coating 20 to achieve the objective of greatly extending the number of years during which the transducer can be kept submerged without deterioration of the leakage resistance to an unacceptable level. A container 21 which holds a waterproof epoxy compound 22 is placed on a platform 23 which rests on the base 24 of a vacuum chamber 25. A rod 26 which is attached to the bottom of the platform 23 passes through a vacuum tight clearance hole in the base plate 24 and is used to lift the container 21 when desired. A cylindrical glass cylinder 28 and top plate 27 complete the vacuum chamber assembly.

A tapered rubber plug 29 with a center clearance hole for the cable 7 is cut radially to permit passage of the cable from the outer edge of the rubber plug to the center hole. The tapered plug is then pressed into a clearance hole through the top plate 27 to seal the transducer element assembly into the vacuum chamber. A vacuum pump 31 is sealed to the vacuum chamber through an exhaust pipe 30 as shown schematically in FIG. 2.

When the transducer element assembly comprising the cable 7, the ceramic cylinder 1 with outer electrode surface 3 and end caps 4 and 5 is suspended above the container 21 inside the vacuum chamber 25 as illustrated in FIG. 2, the vacuum pump 29 is operated to degas the epoxy 22 after which the platform 23 is raised by the sealed handle 26 to completely submerge the transducer element assembly. Then the epoxy container 21 is lowered leaving a thin coating of air-free epoxy totally covering the transducer assembly. The procedure may be repeated after the epoxy is cured to apply a second coat or even additional successive coats if the application is for very low frequency applications and extremely high leakage resistance is to be reliably maintained for submerged periods of ten years or more. The degassed epoxy layer which is deposited over the outer surface of the transducer element assembly is shown as 20 in FIG. 1.

After applying the desired number of vacuum air-free coatings of epoxy, the coated assembly is molded with an elastomer covering 19 as illustrated in FIG. 1. The epoxy coating applied before molding the elastomer outer covering will very greatly increase the number of years that the improved hydrophone assembly will maintain the very high leakage resistance desired. This improvement has been confirmed by experimental data obtained by applicant which showed that a leakage resistance in the order of 1000 megohms has been maintained during several thousand hours of continuous submergence in water of a vacuum degassed epoxy coated assembly before adding the molded Neoprene outer jacket.

Figure 3:
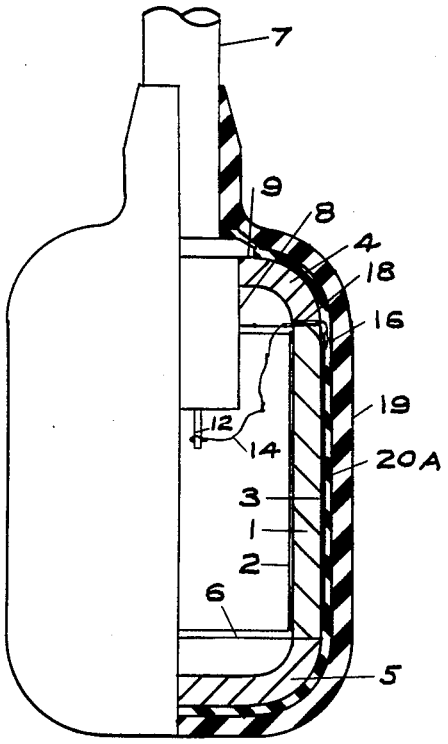
FIG. 3 illustrates another method of applying the teachings of this invention to greatly extend the long time reliability in maintaining very high leakage resistance between the electrode surface of the transducer element assembly and the water within which the hydrophone is immersed.

FIG. 3 shows another illustration for applying the teachings of this invention. The basic hydrophone assembly in FIG. 3 is identical to the assembly of FIG. 1. Before molding the protective conventional Neoprene jacket 19, a jacket of low water permiability elastomer such as Butyl rubber is molded as a covering 20A over the cylindrical transducer element assembly. The Butyl rubber has more than 10 times the resistance to the permiability of water molecules through its wall as compared to Neoprene. The mechanical properties of Butyl and its resistance to hydrocarbons is less satisfactory than Neoprene; therefore, by molding a Neoprene covering over the Butyl layer will protect the Butyl mechanically and the protected Butyl layer will reduce the deterioration of the high leakage resistance as experienced when only a Neoprene covering is molded directly to the transducer element assembly.

Several examples have been given of how to apply applicants' invention for the improvement of long time reliability in maintaining very high leakage resistance in an underwater transducer between the electrode surfaces of the transducer assembly and the water in which the transducer is immersed. The basic teaching provides for the use of a multiple layer protective housing structure in which the material for the inner layer is chosen for its excellence in preventing water permiability such as epoxy, Butyl rubber, or equivalent materials and use an outer layer of Neoprene or a similar material bonded over the inner layer for its excellent mechanical properties.

Although a few specific examples have been given to illustrate the advantages of the disclosed invention, it should be understood that various additional modifications and alternative constructions may be made without departing from the true spirit and scope of the invention. Therefore, the appended claims are intended to cover all such equivalent alternative constructions that fall within their true spirit and scope.

I claim:

1. In combination in an underwater transducer, an electroacoustic transducer element assembly for converting sound vibrations into electrical signals, electrical terminal means attached to said electroacoustic transducer element, sound-transparent waterproof elastomeric housing means surrounding and enclosing said electroacoustic transducer element assembly, waterproof external electrical conductor means sealed to said waterproof housing means and electrically connected to said electrical terminal means, means for increasing the leakage resistance to the order of 1000 megohms or more between said electrical terminal means and the water when said transducer is immersed in water for long periods of time, said means for increasing the leakage resistance includes the coating of the outer surfaces of said transducer element assembly to which said electrical terminal means have been attached with a waterproof layer of high electrical resistance compound before said elastomeric housing means is added to complete the underwater transducer assembly.

2. The invention in claim 1 characterized in that said waterproof layer of high electrical resistance compound is an elastomer with low water permeability such as Butyl rubber or equivalent.

3. The invention in claim 2 further characterized in that a second elastomer having rugged mechanical properties such as Neoprene is bonded to said waterproof elastomer layer of Butyl-like rubber.

4. The invention in claim 1 characterized in that said layer of high electrical resistance compound is an epoxy-like material.

5. The invention in claim 4 further characterized in that said epoxy-like material is degassed by exposing the material to a vacuum while it is in the liquid state.

6. The invention in claim 5 further characterized in that the degassed epoxy liquid is applied as a coating by dipping said electroacoustic transducer element assembly into the degassed liquid and then curing the liquid coating to a solid layer.

7. The invention in claim 6 further characterized in that an additional coating is applied over the previously cured coating whereby the leakage resistance will be further increased over longer periods of submergence of the transducers.

8. The invention in claim 1 characterized in that said transducer element assembly includes a polarized ceramic cylinder or ring and further characterized in that said sound-transparent housing means comprises an elastomer material bonded directly to the outer surfaces of said solid waterproof layer of high electrical resistance compound.

9. The invention in claim 8 further characterized in that said layer of high electrical resistance compound is an epoxy-like material and still further characterized in that said epoxy-like material is degassed under vacuum while it is in the liquid state and then applied as a coating by dipping said transducer element assembly into the degassed liquid and then curing the liquid coating to a solid layer.

10. The invention in claim 9 further characterized in that an additional layer of degassed high electrical resistance compound is applied over the previously cured coating whereby the leakage resistance will be further increased over longer periods of submergence of the transducer.

* * * * *